US005748067A

United States Patent [19]

Ishii et al.

[11] Patent Number: 5,748,067

[45] Date of Patent: May 5, 1998

[54] FUSE WITH LOW-MELTING POINT METAL AND STRUCTURE FOR HOLDING THE FUSE

[75] Inventors: Takashi Ishii; Naoki Matsuoka, both of Shizuoka, Japan

[73] Assignee: Yazaki Corporation, Tokyo, Japan

[21] Appl. No.: 770,146

[22] Filed: Dec. 19, 1996

[30] Foreign Application Priority Data

Dec. 20, 1995 [JP] Japan ..... 7-331904
Sep. 2, 1996 [JP] Japan ..... 8-231942

[51] Int. Cl.[6] ..... H01H 85/04

[52] U.S. Cl. ..... 337/160; 337/152; 337/198; 439/621

[58] Field of Search ..... 337/160, 152, 337/166, 198, 260, 261, 262, 264, 265; 439/621, 622

[56] References Cited

U.S. PATENT DOCUMENTS 4,944,084 7/1990 Horibe ..... 337/160
5,262,751 11/1993 Kudo ..... 337/296
5,416,461 5/1995 Totsuka ..... 337/261
5,528,213 6/1996 Kondo ..... 337/160
5,605,719 2/1997 Tench ..... 427/248.1

FOREIGN PATENT DOCUMENTS 63-93045 6/1988 Japan .
64-60937 3/1989 Japan .

*Primary Examiner*—Leo P. Picard
*Assistant Examiner*—Jayprakash N. Gandhi
*Attorney, Agent, or Firm*—Morgan, Lewis & Bockius LLP

[57] ABSTRACT

There is provided a fusing portion constituted by a high-melting point fusible metal element for coupling a pair of box-type terminals in the form of a link, and a low-melting point fusible metal element disposed at a substantially center portion of the high-melting point fusible metal element and containing a reducing element.

9 Claims, 3 Drawing Sheets

FUSE WITH LOW-MELTING POINT METAL AND STRUCTURE FOR HOLDING THE FUSE

BACKGROUND OF THE INVENTION

The present invention relates to a fuse with low-melting point metal and a structure for holding the fuse, in which the fuse has a high-melting point metal element and a low-melting point metal element so as to have two kinds of fusing properties.

As well known, a fuse is provided to protect an electric circuit by breaking connection between the circuit and a power supply when an overcurrent due to an overload or a shortcircuit flows in the circuit.

Having such a function, to break a circuit with a simple structure, fuses have been used widely. For example, in a case where a fuse is used in a power supply circuit of a circuit system for driving the electric equipment of a car, sometimes a fuse link, in which a pair of box-type terminals and an element are coupled with each other in the form of a link is used.

The element for coupling the pair of box-type terminals is formed of high-melting point fusible metal to fuse immediately when an overcurrent flows. Although breaking is carried out quickly when a large current flows in this high-melting point fusible metal element, there is a fuse in which a low-melting point fusible metal element is additionally provided so that breaking is carried out slowly by Joule heat generated when a small current flows.

FIG. 4 is a perspective view illustrating a prior art fuse link having a fuse for fusing quickly and slowly as mentioned above. That is, in a fuse link 10, extending portions 1*a* and 1*b* extended from a pair of box-type terminals 1A and 1B are coupled with each other through an element 2 consisting of high-melting point fusible metal such as copper which fuses quickly. A caulk portion 2*a* for caulking a tin chip 7 of low-melting point fusible metal which fuses slowly is formed from opposite sides in the widthwise direction of the substantially center portion of the element 2. The tin chip 7 caulked by the caulk portion 2*a* is welded to the element 2 by a heat beam.

The tin chip 7 is coated with flux so that the tin chip is welded to the element 2 surely. Since the flux adheres to the surface after the fusing, the flux is cleansed and removed.

In addition, projections 1*c* and 1*d* for engaging with a housing which will be described later are formed in the opposite sides of the pair of box-type terminals 1A and 1B.

FIG. 5 shows the housing for receiving the fuse link 10 shown in FIG. 4. That is, the housing 4 is a rectangular solid with its upper surface opened. A pair of lock projections 4*a* and 4*b*, the insides of which are hollow and the outsides of which are expanded, are formed near the upper end edge of the housing 4. The lock projections 4*a* and 4*b* engage with lock holes 5*a* and 5*b* which are formed in tongue portions 5A and 5B formed in a cover 5.

The cover 5 is attached to the open side of the upper surface of the housing 4 after the fuse link 10 is inserted into the housing 4.

As mentioned above, in a conventional fuse having quickly and slowly fusing properties, there is a welding step to be carried out after a low-melting point fusible metal element such as tin is caulked by a high-melting point fusible metal element. However, such a welding failure (ie that welded metal is not perfectly welded to the element), such a welding shape failure (ie that the shape of the welded metal is abnormal), and so on, are sometimes generated. In addition, since the melted metal is coated with flux in order to weld the melted metal surely, there is a problem that this flux must be removed by cleansing after the welding.

In addition, although the fuse is provided with two properties, that is, quickly and slowly fusing properties, by a combination of a low-melting point fusible metal element and a high-melting point fusible metal element, there is also a problem that it is impossible to judge whether breaking is caused by a large current or by a small current at the time of the breaking.

SUMMARY OF THE INVENTION

Taking the foregoing circumstances into consideration, the present invention has been made, and an object thereof is to provide a fuse with low-melting point metal in which a low-melting point fusible metal element can be tightly attached to a high-melting point fusible metal element surely, and the number of steps such as flux removal is reduced so that the cost can be reduced.

Another object of the present invention is to provide a structure for holding a fuse with low-melting point metal in which it is possible to judge whether breaking is caused by a large current or by a small current.

In order to attain the above object, according to the present invention, the fuse with low-melting point metal has a fusing portion constituted by a high-melting point fusible metal element for coupling a pair of box-type terminals in the form of a link, and a low-melting point fusible metal element disposed at a substantially center portion of the high-melting point fusible metal element and containing a reducing element.

As the reducing element, phosphorus may be used.

The fusing portion may be constituted by: a pair of pressure contact blades disposed in a position in the direction perpendicular to the longitudinal direction of the low-melting point fusible metal element to cut the low-melting point fusible metal element with a widthwise length thereof when the low-melting point fusible metal element is pressed into the blades; and fitting portions following lower portions of the pair of pressure contact blades so as to be fitted into the low-melting point fusible metal element.

According to the present invention, the structure for holding a fuse with low-melting point metal has a fusing portion constituted by a high-melting point fusible metal element for coupling a pair of box-type terminals in the form of a link, and a low-melting point fusible metal element disposed at a substantially center portion of the high-melting point metal element; the fusing portion being constituted by: a pair of pressure contact blades disposed in a position in the direction perpendicular to the longitudinal direction of the low-melting point fusible metal element to cut the low-melting point fusible metal element by a widthwise length thereof when the low-melting point fusible metal element is pressed into the blades; and fitting portions following lower portions of the pair of pressure contact blades so as to be fitted into the low-melting point fusible metal element.

As for a step of welding, there are light beam welding and heat welding. The heat welding has an advantage that scattering in welding temperature is less because a temperature detecting sensor is attached to a heater chip (molybdenum material) so as to control the welding temperature. Therefore, it is desirable that metal be welded to an element by heat welding.

However, in order to perform welding surely, it is necessary to remove a surface oxide film so as to disperse melted metal onto the element satisfactorily, and therefore flux to remove the surface oxide film has been indispensable conventionally. However, in the present invention, instead of flux, a reducing element is contained in low-melting point metal so as to remove a surface oxide film satisfactorily. Thus, heat welding can be therefore employed.

In addition, in the holding structure where a low-melting point fusible metal is pressed into pressure contact blades, since an oxide film on the surface of the metal is removed when the metal is pressed into the contact blades, it is possible to make the metal disperse onto an element at the time of welding. Also in this holding structure, because a reducing element is contained in the metal, it is possible to make the metal disperse onto the element more effectively.

DETAILED DESCRIPTION OF THE INVENTION

Figure 4:
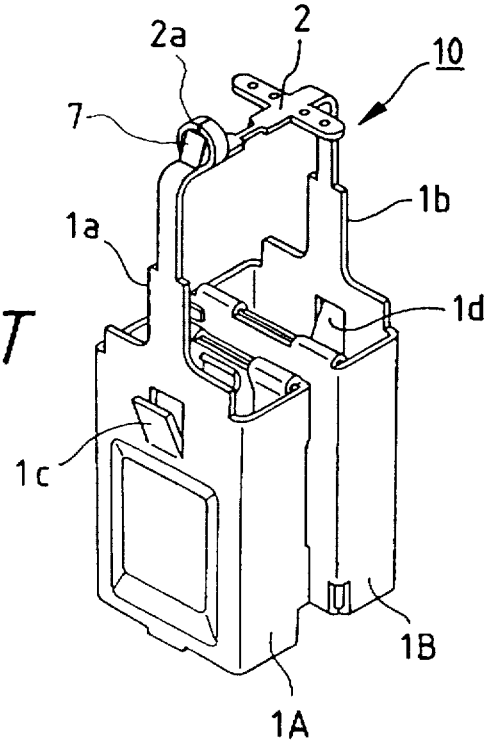
FIG. 4 PRIOR ART
FIG. 4 is a perspective view illustrating a conventional fuse link.
Figure 5:
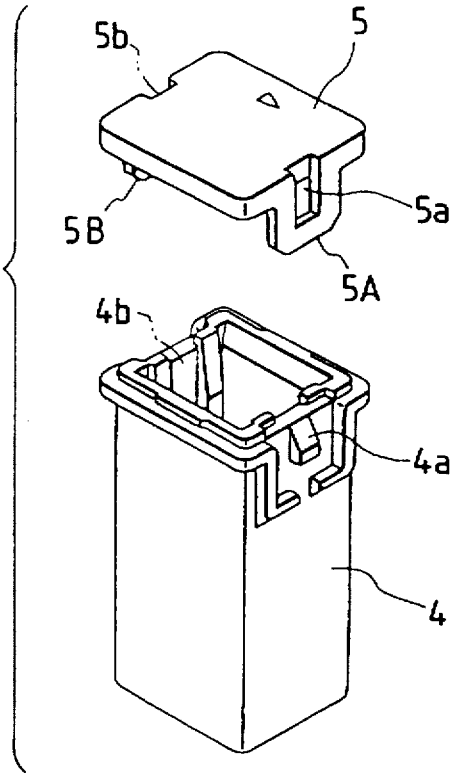
FIG. 5 PRIOR ART
FIG. 5 is a perspective view illustrating a housing for receiving the fuse link shown in FIG. 4.

Preferred embodiments of the present invention will be described with reference to the drawings. Parts equivalent to those described in FIGS. 4 and 5 will be designated by the same reference numerals, and their detailed description will be omitted.

Figure 1:
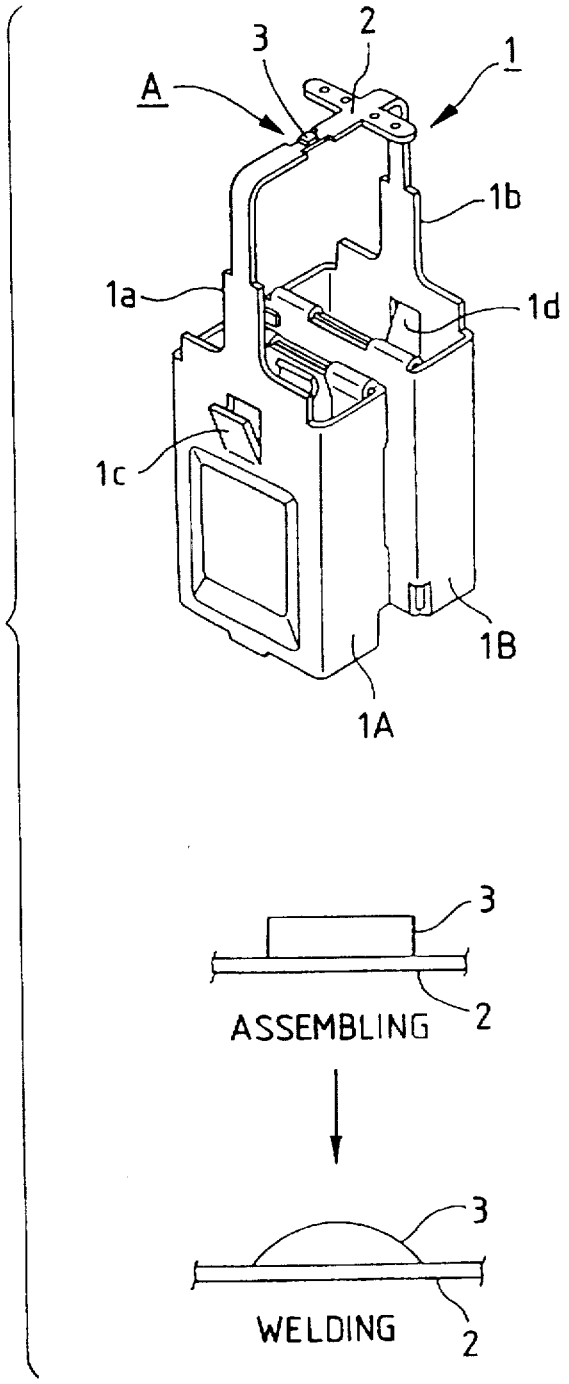
FIG. 1 is a perspective view illustrating a fuse link having a fuse according to the present invention.

FIG. 1 is a perspective view illustrating the configuration of a fuse link 1. In FIG. 1, extending portions 1*a* and 1*b* are extended from a pair of box-type terminals 1A and 1B, and these extending portions 1*a* and 1*b* are coupled with each other through a high-melting point fusible metal element 2. A fusing portion A is formed at a substantially center portion of the element 2.

The fusing portion A has a structure where a low-melting point fusible metal element 3 is mounted on the high-melting point fusible metal element 2. The fusible metal element 2 is formed of copper or the like, and the fusible metal element 3 is formed of tin or the like and contains a reducing element. After being attached onto the fusible metal element 2, the fusible metal element 3 is welded to the fusible metal element 2.

Since the surfaces of the fusible metal elements 2 and 3 are oxidized, welding is prevented by the surface tension acting on those fusible elements 2 and 3 when the fusible metal element 3 is welded to the fusible metal element 2.

On the other hand, when the low-melting point fusible metal element 3 containing a reducing element according to the present invention is melted, the reducing element acts, in a liquefied mode, onto the fusible metal element 2 which acts as base material. Accordingly, the surface of the fusible metal element 2 is neutralized and cleansed so that the fusible metal element 3 is well welded to the element 2. Phosphorus may be used as the reducing element.

Figure 2:
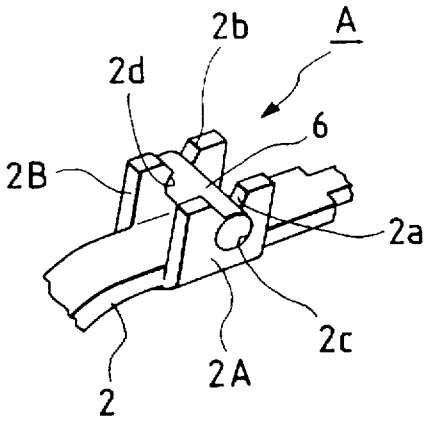
FIG. 2 is a perspective view illustrating another structure of a fusing portion A of the fuse link shown in FIG. 1.

FIG. 2 is a perspective view illustrating another configuration of the fusing portion A of the fuse link 1. In the fusing portion A, holding portions 2A and 2B are formed respectively at opposite side edges of the element 2. The holding portions 2A and 2B have V-shape pressure contact blades 2*a* and 2*b* formed in their upper edges, and circular fitting portions 2*c* and 2*d* following the lower portions of the pressure contact blades 2*a* and 2*b*, respectively.

The shape of each of the fitting portions 2*c* and 2*d* is not limited to the illustrated circle to which a metal wire 6 circular in section is to be fitted, but it can be modified desirably in accordance with the sectional shape of the metal wire 6.

The metal wire 6 held by the holding portions 2A and 2B consists of low-melting point fusible metal such as tin which contains a reducing element such as phosphorus. When this metal wire 6 is pressed into the pressure contact blades 2*a* and 2*b* of the holding portion 2A and 2B, the metal wire 6 is cut by the widthwise size of the element 2 by the pressure contact blades 2*a* and 2*b*, and the opposite ends of the metal wire 6 are fitted into the fitting portions 2*c* and 2*d* respectively. The metal wire 6 is held at a predetermined distance from the element 2.

Obviously, the metal wire 6 may also be formed of ordinary fusible metal which contains no reducing element.

With the fusing portion configured as shown in FIG. 2, it is possible to judge whether breaking is caused by a small current or by a large current.

That is, when a small current flows into the fuse link 1, Joule heat is generated in the metal wire 6. When the conducted current exceeds a predetermined value, the temperature reaches the melting point of the metal wire 6 so that the metal wire 6 is melted, and the melted metal diffuses so as to be welded to the element 2 so that the element 2 is fused.

Since a metal oxide film on the surface of the metal wire 6 to be press-contacted to the element 2 is removed when the metal wire 6 is press-contacted, the melted metal is welded to the element 2 satisfactorily. When the metal wire 6 contains a reducing element, the surface oxide film on the surface is removed positively, so that the property of welding is improved.

On the other hand, when a large current flows into the fuse link 1, the high-melting point fusible metal element 2 breaks immediately. At this time, the low-melting point metal wire 6 keeps its linear shape without breaking because the temperature of the metal wire 6 does not reach its melting point. As a result, only the element 2 breaks.

In a circuit using an electric motor, the metal wire 6 generates heat even by a lock current which is a small current generated when the motor locks. Even if such a lock current is generated, however, the element 2 does not fuse immediately.

That is, since the metal wire 6 is not yet welded to the element 2 in its initial state, the steps of melting of the metal wire 6, and diffusion and welding of the melted metal to the element 2 must be carried out before the element 2 fuses. Therefore, even if the lock current is generated so that the metal wire 6 generates heat, it takes considerable time for both the metal wire 6 and the element 2 to break. Accordingly, the durability against the lock current is improved.

When the metal wire 6 is welded to the element 2 by the generation of such a lock current, the element 2 fuses in the same manner as in the conventional case. Accordingly, the fusing standard of the element is satisfied even though the durability against a lock current is improved.

Figure 3:
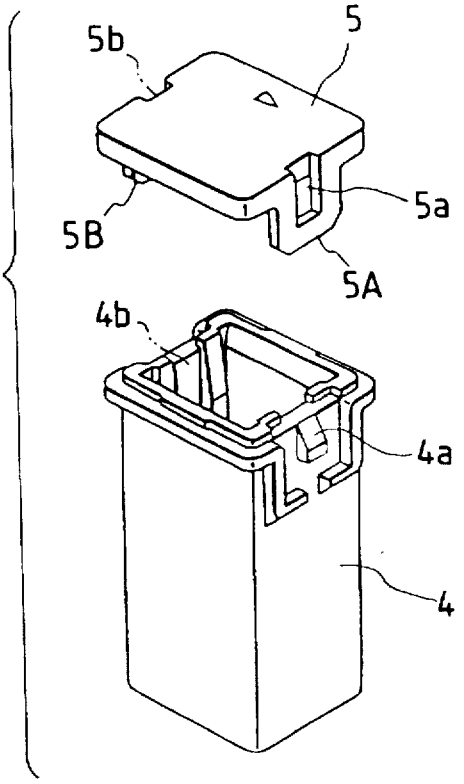
FIG. 3 is a perspective view illustrating a housing for receiving the fuse link shown in FIG. 1.

FIG. 3 shows a housing 4 into which the fuse link 1 depicted in FIG. 1 is inserted. The housing 4 has a configuration similar to that shown in FIG. 5, and lock projections 4a and 4b are formed on the housing 4 so as to engage with lock holes 5a and 5b of tongue portions 5A and 5B which are formed on a cover 5.

The fuse link 1 is inserted into the thus configured housing 4 from the bottom side of the box-type terminals 1A and 1B, and the projections 1c and 1d are engaged with not-shown lock grooves of the housing 4. By this means, the fuse link 1 is stored in the housing 4.

After that, the cover 5 is put on the upper opening of the housing 4. The cover 5 also has a configuration similar to that shown in FIG. 5, and the lock holes 5a and 5b formed in the tongue portions 5A and 5B of the cover 5 are engaged with the lock projections 4a and 4b of the housing 4 so that the upper opening of the housing 4 is closed.

The fusing properties of the fuse with low-melting point metal will be described below on the basis of experiments.

Table 2 shows average values (expressed by seconds) of initial fusing time when samples (inventive products 1 to 4) containing 250 ppm phosphorus as a reducing element, a sample (comparative product 1) containing no reducing element but coated with flux, and samples (comparatives products 2 and 3) containing no reducing elements and coated with no flux, were thermally welded to tin chips (1.33 mm (rectangular wire)×2.1 mm (manually caulking)) in the welding conditions shown in Table 1, and a current (600%, 350%, 200%, 135% and 110%) was applied five times to each of the samples. Where, for example, a current (600%) means a current value (180A for example) obtained by multiplying a rated value (30A for example) of a fuse by (600%/100). Initial fusing time of a sample (comparative product 4 containing no reducing element but coated with flux) welded by a light beam is also shown for the sake of comparison.

TABLE 1

| | Temperature (°C.) | Time (sec) | Flux |
|---|---|---|---|
| Inventive product 1 | 450 | 3.0 | no |
| Inventive product 2 | 450 | 5.0 | no |
| Inventive product 3 | 450 | 2.0 | no |
| Inventive product 4 | 450 | 0.5 | no |
| Comparative product 1 | 400 | 0.5 | yes |
| Comparative product 2 | 450 | 1.5 | no |
| Comparative product 3 | 450 | 3.0 | no |

TABLE 2

| | 600% | 350% | 200% | 135% | 110% |
|---|---|---|---|---|---|
| Inven. pro. 1 | 0.32 | 1.42 | 23.1 | 1711 | over 4 hours |
| Inven. pro. 2 | 0.32 | 1.44 | 23.2 | 1754 | |
| Inven. pro. 3 | 0.32 | 1.45 | 20.9 | 1782 | |
| Inven. pro. 4 | 0.32 | 1.41 | 20.9 | 1723 | |
| Com. pro. 1 | — (no data) | — | — | 1467 | — |
| Com. pro. 2 | — | — | — | 2764 | — |
| Com. pro. 3 | — | — | — | 2092 | — |
| Com. pro. 4 | 0.31 | 1.45 | 20.7 | 1644 | over 4 hours |
| Standard value | 0.04–1 | 0.2–7 | 5–100 | 60–1800 | over 4 hours |

unit: second

Paying attention to the case of 135% current conduction, though the standard of the initial fusing time in this case is 60 to 1,800 seconds, the initial fusing time is over the range of the standard in the samples (comparative products 2 and 3) without containing any reducing element and thermally welded. On the other hand, in the case of all the samples (inventive products 1 to 4) which contain a reducing element, the initial fusing time satisfies the standard.

In addition, since the surface oxide of copper is removed by the contained reducing element, the standard is satisfied even in short-time thermal welding as shown in the inventive product 4.

In the case of containing a reducing element, there is no difference in fusing time between thermal welding and light beam welding as shown in the comparative product 4.

As described above, it was confirmed that when a reducing element is contained, it is possible satisfy the standard of fusing time even in the case of thermal welding without using flux, and there is no difference in fusing time between thermal welding and light beam welding.

It was confirmed that it is possible to improve the reducing effect by increasing the quantity of the reducing element, and it is possible to obtain a good reducing effect in the range of from 250 ppm to 500 ppm.

As described above in detail, according to the present invention, because a low-melting point fusible metal contains a reducing element, the reducing element is liquidized to act on the surface of a base material (a high-melting point fusible metal element) at the time of welding so that the surface of the base material is cleansed to remove the surface oxide film. As a result, flux which has been used conventionally becomes unnecessary, so that conventional steps such as applying flux and cleansing and removing the flux after welding are not required.

Further, by such a structure that a low-melting point fusible metal element which is fused when a small current is supplied is held on a high-melting point fusible metal element, it is possible to judge whether breaking is caused by a large current or by a small current, when the fuse breaks.

Further, since it takes a considerably long time for the low-melting point fusible metal wire to be melted by a small current supplied thereto, the low-melting point fusible metal wire is not fused immediately even when a lock current, which is a small current, is generated. As a result, it is possible to improve the durability against such a lock current.

Further, it is possible to remove an oxide film on the surface of metal when a low-melting point metal element is pressed in, and it is possible to diffuse the metal onto the element at the time of welding. Further, it is possible to judge whether breaking is caused by a large current or by a small current when the fuse breaks, and, at the same time, it is possible to improve the durability against a lock current.

What is claimed is:

1. A fuse with a low-melting point metal, comprising:

a pair of box-type terminals; and a fusing portion comprised of a high-melting point fusible metal element for coupling said pair of box-type terminals in a form of a link, and a low-melting point fusible metal element disposed at a substantially center portion of said high-melting point fusible metal element and containing a reducing element, whereby welding properties are improved by removal of surface oxides.

2. A fuse with low-melting point metal according to claim 1, wherein said reducing element is phosphorus.

3. A fuse with low-melting point metal according to claim 1, wherein said low-melting point fusible metal element is mounted on said high-melting point fusible metal element.

4. A fuse with low-melting point metal according to claim 1, wherein said fusing portion comprises:

a pair of pressure contact blades disposed in a position in a direction perpendicular to a longitudinal direction of said low-melting point fusible metal element to cut said low-melting point fusible metal element when said low-melting point fusible metal element is pressed into said blades; and fitting portions located on lower portions of said pair of pressure contact blades so as to receive said low-melting point fusible metal element.

5. A fuse with low-melting point metal according to claim 2, wherein said fusing portion comprises:

a pair of pressure contact blades disposed in a position in a direction perpendicular to a longitudinal direction of said low-melting point fusible metal element to cut said low-melting point fusible metal element when said low-melting point fusible metal element is pressed into said blades; and fitting portions located on lower portions of said pair of pressure contact blades so as to receive said low-melting point fusible metal element.

6. A structure for holding a fuse with low-melting point metal, comprising:

a fusing portion comprised of a high-melting point fusible metal element for coupling a pair of box-type terminals in the form of a link, and a low-melting point fusible metal element disposed at a substantially center portion of said high-melting point fusible metal element;

wherein said fusing portion comprises:

a pair of pressure contact blades disposed in a position in a direction perpendicular to a longitudinal direction of said low-melting point fusible metal element to cut said low-melting point fusible metal element when said low-melting point fusible metal element is pressed into said blades; and fitting portions located on lower portions of said pair of pressure contact blades so as to receive said low-melting point fusible metal element.

7. The structure for holding a fuse with low-melting point metal according to claim 6, wherein said low-melting point fusible metal element contains a reducing element.

8. The structure for holding a fuse with low-melting point metal according to claim 7, wherein said reducing element is phosphorus.

9. The structure for holding a fuse with low-melting point metal according to claim 6, wherein said low-melting point fusible metal element is mounted on said high-melting point fusible metal element.

* * * * *